United States Patent [19]

Schauer et al.

[11] Patent Number: 4,949,454

[45] Date of Patent: Aug. 21, 1990

[54] METHOD FOR MAKING AN ELECTRICAL CONNECTION TO A FLAT ELECTRICAL CONDUCTOR

[75] Inventors: Friedrich Schauer, Heroldsberg; Manfred Wolff, Schwarzenbruch, both of Fed. Rep. of Germany

[73] Assignee: Kabelmetal Electro GmbH, Hanover, Fed. Rep. of Germany

[21] Appl. No.: 433,156

[22] Filed: Nov. 8, 1989

[30] Foreign Application Priority Data

Nov. 26, 1988 [DE] Fed. Rep. of Germany ..... 3840014

[51] Int. Cl.[5] ..... H01R 43/02

[52] U.S. Cl. ..... 29/860; 174/84 C; 174/94 R; 439/492

[58] Field of Search ..... 174/88 R, 94 R, 84 C; 29/866, 860, 874; 439/492, 422

[56] References Cited

U.S. PATENT DOCUMENTS

| | | | |
|---|---|---|---|
| 2,996,026 | 8/1961 | Batchelle | 29/874 |
| 3,197,729 | 7/1965 | Sarazen | 174/88 R X |
| 3,247,316 | 4/1966 | Weimer, Jr. | 174/84 C X |
| 3,715,457 | 2/1973 | Teagno et al. | 174/88 R |
| 4,310,719 | 1/1982 | Cross et al. | 174/94 R |
| 4,554,406 | 11/1985 | Slavin et al. | 174/94 R |
| 4,768,287 | 9/1988 | Thies | 174/84 C X |

OTHER PUBLICATIONS

IBM Tech. Discl. Bull., vol. 4, No. 8, Jan. 1962, p. 5, by R. D. Cargill et al.

*Primary Examiner*—Carl E. Hall
*Assistant Examiner*—Carl J. Arbes
*Attorney, Agent, or Firm*—James C. Jangarathis

[57] ABSTRACT

A method is described for making an electrical through connection between a first insulated condution line including a flat electrical conductor to a second insulated electrical conduction line. An elongated connecting device including a plurality of transverse claws at one end, an attachment member at the other end, and a base member in between is employed in the steps of removing an end portion of the insulation layer on each of the conduction lines; placing the transverse claws adjacent to the first insulated conduction line and deforming the claws into the insulation layer thereof to achieve a fixed longitudinal retention, such deforming including the application of a force sufficient to cause claw penetration into only the insulation layer and not into the flat electrical conductor; bonding the exposed end portion of the flat electrical conductor to the base member for achieving an electrical connection thereto; and affixing the attachment member to the exposed end portion of the second conduction line for achieving an electrical connection thereto.

8 Claims, 1 Drawing Sheet

METHOD FOR MAKING AN ELECTRICAL CONNECTION TO A FLAT ELECTRICAL CONDUCTOR

The invention relates to a method of making an electrical through connection between a first insulated conduction line including a flat electrical conductor, to a second insulated electrical conduction line; and, more particularly, to such a method employing a connecting device comprised of a deformable conductive metal having transverse claws for insulation penetration.

BACKGROUND OF THE INVENTION

Connecting devices comprised of deformable conductive metals and including transverse claws at one end are priorly known. Such devices are often employed in providing electrical connections to insulated conductors in general, and not to conductors having flat cross-sections. In particular, such prior connecting devices are employed in a manner to have their transverse claws deformed so as to penetrate both the insulation layers positioned about the conductors and the outer surfaces of the conductors themselves, with the objective of achieving mechanically permanent, and electrically efficient, connections between such connecting devices and the insulated conductors to which they are attached. For the purpose of achieving such dual penetrations, the transverse claws of such connecting devices are deformed with the application of extensive forces. This present a significant disadvantage when the insulated conductors are flat in cross-section since such conductors are readily damaged when penetrated by the deforming transverse claws, and because the insulation layer through which the claws penetrate begins to flow after a period of time, such flow causing the penetrating claws to loosen from the conductors, resulting in ineffective electrical connections.

OBJECTS OF THE INVENTION

An object of the present invention is to provide a novel method wherein connecting devices comprised of deformable conductive metals and including transverse claws at one end, are employed to make efficient electrical connections to insulated conductors having flat cross-sections.

Another object of the present invention is to achieve such electrical connections without the danger of damaging the flat insulated conductors, while assuring the permanence of such connections.

SUMMARY OF THE INVENTION

These and other objects of the present invention are achieved by a method of making an electrical through connection between a first insulated conduction line including a flat electrical conductor, to a second insulated electrical conduction line including a second electrical conductor means. An elongated connecting device including a plurality of transverse claws at one end, an attachment member at the other end, and a base member in between is employed in the steps of removing an end portion of the insulation layer on each of the conduction lines; placing the transverse claws adjacent to the first insulated conduction line and deforming such claws into the insulation layer thereof to achieve a fixed longitudinal retention, such deforming including the application of a force sufficient to cause claw penetration only into the insulation layer, and not into the flat electrical conductor; bonding the exposed end portion of the flat electrical conductor to the bas member for achieving an electrical connection thereto; and affixing the attachment member to the exposed end portion of the second electrical conductor means for achieving an electrical connection thereto.

BRIEF DESCRIPTION OF THE DRAWINGS

A better understanding of the present invention as well as the objects and advantages thereof will become apparent upon consideration of the following disclosure thereof, especially when taken with the accompanying drawings, wherein:

Referring to FIG. 1, there is depicted an elongated, unitary connecting device 1 comprised of a deformable conductive metal, for example, a copper alloy. The unitary connecting device 1 includes at one end thereof, a plurality of transverse claws 2, and at the other end thereof, a longitudinally hollow, attachment member 3 having a circular cross-section. Alternatively, the attachment member 3 may have a U-shaped crosssection. Between the plurality of transverse claws 2 and the attachment member 3, there is provided an elongated base member 4. The unitary connecting device 1 is employed in accordance with the present invention to provide an electrical connection between an end of an insulated electrical conduction line 15 comprising an electrical conductor 5 having a flat cross-section, and an end of an insulated electrical conduction line 16 comprising a plurality of electrical conductors 6 formed as a strand or bundle with a circular cross-section.

As illustrated in FIG. 2, an end portion of an insulation layer 17 of the electrical conduction line 15 is removed to expose an end portion of the flat electrical conductor 5, and an end portion of an insulation layer 18 of the electrical conduction line 16 is removed to expose an end portion of the plurality of electrical conductors 6. With reference to FIG. 3, the unitary connecting device 1 is then placed adjacent to the insulated electrical conduction line 15 so that the plurality of transverse claws 2 are positioned opposite a portion of the insulation layer 17. Thereafter, the plurality of transverse claws 2 are deformed about and into the adjacent insulation layer 17, such deformation being by the application of a pressure sufficient only to cause claws 2 to penetrate into the insulation layer 17, up to but not penetrating the flat surface of the flat electrical conductor 5. Consequently, a fixed longitudinal retention is established between the unitary connecting device 1 and the electrical conduction line 15. With such fixed longitudinal retention, the exposed end portion of the electrical conductor 5 extends longitudinally adjacent to a major surface of the elongated base member 4. In an area 7 of such adjacency, the flat electrical conductor 5 is bonded to the elongated base member 4 by, for example, a soldering or welding step, to achieve an electrical connection between such flat electrical conductor 5 and the unitary connecting device 1. For soldering purposes, the exposed portion of the flat electrical conductor 5 may be tinned prior to the step of deforming the transverse claws 5 into the insulation layer 17.

To connect the longitudinally hollow attachment member 3 of the unitary connecting device 1 to the exposed end portions of the plurality of electrical conductors 6, a soldering agent is first applied to such exposed portions, and the attachment member 3 is positioned about such exposed portions and compressed thereabout. The application of heat to such exposed portions of the plurality of electrical conductors 6, during or after the attachment member 3 is compressed thereabout, causes a liquification of the soldering agent for achieving a soldering of the internal surface of the attachment member 3 to the electrical conductors 6, and additionally causing a soldering of the various end portions, thus providing an electrical connection between the electrical conductors 6 and the unitary connecting device 1.

Figure 1:
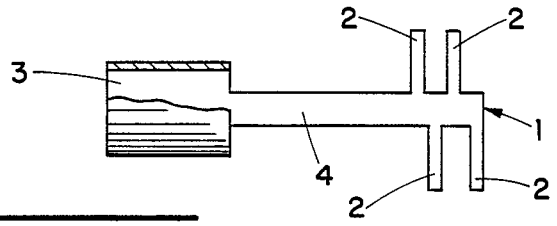
FIG. 1 is a schematic view of a connecting device employed in the exercise of the method of the present invention.
Figure 2:
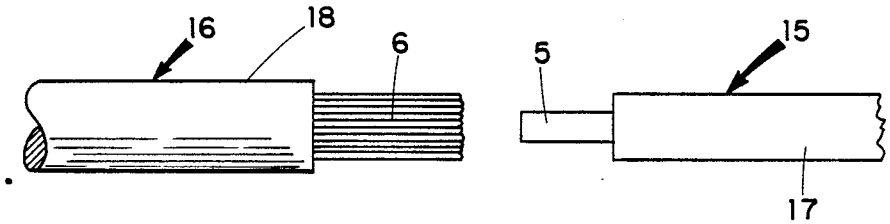
FIG. 2 is a schematic view of two electrical conduction lines the constituent conductors of which are to be connected end-to-end by the connecting device of FIG. 1.
Figure 3:
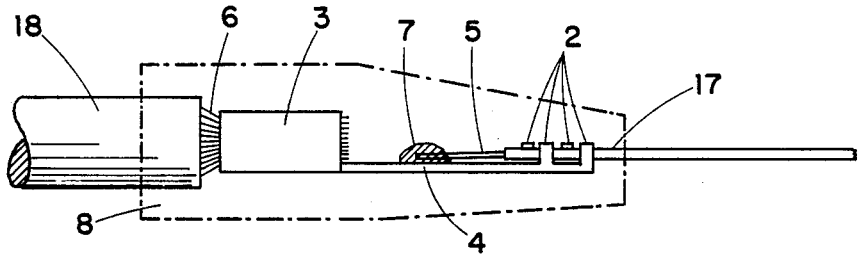
FIG. 3 is a side view representation of the two electrical conduction lines of FIG. 2, connected by means of the connecting device of FIG. 1.

As illustrated in FIG. 3, a plastic protective housing 8, indicated by a dash-dotted perimeter line, is injection molded around the connections formed between the insulated electrical conductor lines 15 and 16, by the unitary connecting device 1, such housing extending longitudinally along a portion of the insulation layer 17 and a portion of the insulation layer 18 for providing a complete hermetic seal.

Figure 4:
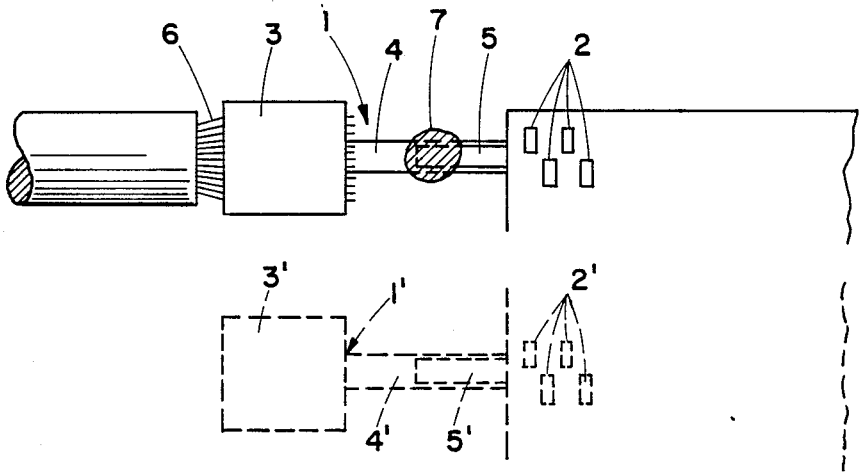
FIG. 4 is a top view representation of an alternate connecting arrangement.

The present method may also be employed for electrical conduction lines wherein two or more flat conductors are arranged side by side. Such a conduction line is schematically represented by FIG. 4. As illustrated therein, a second flat conductor 5' indicated by dash-dot lines, is connected with a further electrical conduction line (not shown) by means of a second unitary connecting device 1'.

While the invention has been described in connection with an exemplary embodiment thereof, it will be understood that many modifications will be apparent to those of ordinary skill in the art and that this application is intended to cover any adaption or variation thereof. Therefore, it is manifestly intended that the invention be only limited by the claims and equivalents thereof.

What is claimed:

1. Method of making an electrical through connection between a first insulated conduction line comprising a first electrical conductor having a flat cross-section, to a second insulated electrical conduction line comprising a second electrical conductor means, comprising the steps of:

removing an end portion of a first insulation layer from said first conduction line to expose an end portion of said first electrical conductor;

removing an end portion of a second insulation layer from said second conduction line to expose an end portion of said second electrical conductor means; and attaching a first elongated connecting device between said first and second conduction lines, said first connecting device being comprised of a deformable conductive metal and including a plurality of transverse claws at one end, an attachment member at the other end, and a base member in between, said attaching of said connecting device, comprising the steps of:

placing said connecting device longitudinally adjacent said first conduction line so that said plurality of transverse claws are opposite a portion of said first insulation layer, and said exposed end portion of said first electrical conductor is opposite said base member;

deforming said plurality of transverse claws into said first insulation layer to provide a fixed longitudinal retention between said first conduction line and said first connecting device, said step of deforming including the application of a force sufficient to cause claw penetration into only said first insulation layer and not into said flat electrical conductor;

bonding said exposed end portion of said first flat electrical conductor to said base member for achieving an electrical connection thereto;

affixing said attachment member of said connecting device to said exposed end portion of said second electrical conductor means for achieving an electrical connection thereto.

2. Method in accordance with claim 1, wherein said second electrical conductor means includes a plurality of stranded wires, and said attachment member has a hollow cross section, said step of affixing said attachment member including positioning said attachment member about said exposed end portion of said second electrical conductor means and compressing said attachment member thereonto.

3. Method in accordance with claim 1, wherein an area of said exposed end portion of said first flat electrical conductor is soldered onto said base member.

4. Method in accordance with claim 3, wherein said exposed end portion of said first flat electrical conductor is tinned before the step of deforming said plurality of transverse claws into said first insulation layer.

5. Method in accordance with claim 1 wherein an area of said exposed end portion of said first electrical conductor is welded to said base member.

6. Method in accordance with claim 2, further comprising the steps of placing a soldering agent onto the exposed end portion of said second electrical conductor means; and applying heat to said exposed end portion to cause a liquification of said soldering agent to achieve a soldering of said attachment member to said exposed end portion.

7. Method in accordance with claim 1, further comprising injection molding a plastic protective housing about the electrical connections formed by said connecting device to said first and second conduction lines, said housing at one end, extending longitudinally along a portion of said first insulation layer, and at the other end extending longitudinally along a portion of said second insulation layer for providing a hermetic seal about said electrical connections.

8. Method in accordance with claim 1, wherein said first insulated conduction line comprises a second electrical conductor having a flat cross-section, said second flat electrical conductor being connected to a second connecting device similar in structure to said first connecting device.

* * * * *